US007532188B2

(12) United States Patent
Yamashita et al.

(10) Patent No.: US 7,532,188 B2
(45) Date of Patent: May 12, 2009

(54) CLOCKED INVERTER CIRCUIT, LATCH CIRCUIT, SHIFT REGISTER CIRCUIT, DRIVE CIRCUIT FOR DISPLAY APPARATUS, AND DISPLAY APPARATUS

(75) Inventors: Junichi Yamashita, Tokyo (JP); Katsuhide Uchino, Kanagawa (JP)

(73) Assignee: Sony Corporation (JP)

( * ) Notice: Subject to any disclaimer, the term of this patent is extended or adjusted under 35 U.S.C. 154(b) by 584 days.

(21) Appl. No.: 10/581,076

(22) PCT Filed: Nov. 18, 2004

(86) PCT No.: PCT/JP2004/017529

§ 371 (c)(1),
(2), (4) Date: May 31, 2006

(87) PCT Pub. No.: WO2005/055427

PCT Pub. Date: Jun. 16, 2005

(65) Prior Publication Data

US 2007/0091014 A1 Apr. 26, 2007

(30) Foreign Application Priority Data

Dec. 1, 2003 (JP) ..... P2003-401274

(51) Int. Cl.
*G09G 3/36* (2006.01)

(52) U.S. Cl. ..... 345/98

(58) Field of Classification Search ..... 345/55–100, 345/204–214; 326/62–98; 327/333
See application file for complete search history.

(56) References Cited

U.S. PATENT DOCUMENTS 6,396,470 B1 * 5/2002 Zhang et al. ..... 345/87
6,462,596 B1 * 10/2002 Varma ..... 327/211
7,006,068 B2 * 2/2006 Haga ..... 345/98
7,038,653 B2 * 5/2006 Moon ..... 345/100
7,289,097 B2 * 10/2007 Gyouten et al. ..... 345/100
7,332,936 B2 * 2/2008 Nagatsuka ..... 345/98
2003/0012330 A1 * 1/2003 Osame ..... 377/2

FOREIGN PATENT DOCUMENTS

JP 54-161288 12/1979
JP 61-206308 9/1986

(Continued)

OTHER PUBLICATIONS

International Search Report mailed Dec. 28, 2004.

(Continued)

*Primary Examiner*—David L Lewis
(74) *Attorney, Agent, or Firm*—Rader Fishman & Grauer PLLC; Ronald P. Kananen

(57) ABSTRACT

The present invention is applied to flat display apparatuses using organic EL devices. Switching circuits implemented by a set of transistors TR1 and TR2 that perform on/off operations in a complementary manner form a series circuit, an output of the connection midpoint of the series circuit is output to an inverter circuit 33, an input signal IN is input to one end of the series circuit, and a signal that is output from an inverter circuit 34 and that corresponds to the output of the connection midpoint of the series circuit is supplied to an opposite end of the series circuit.

8 Claims, 8 Drawing Sheets

FOREIGN PATENT DOCUMENTS

| | | |
|---|---|---|
| JP | 05-102312 | 4/1993 |
| JP | 05-241201 | 9/1993 |
| JP | 05-259834 | 10/1993 |
| JP | 05-265411 | 10/1993 |
| JP | 09-200000 | 7/1997 |
| JP | 09-223948 | 8/1997 |
| JP | 2000-134067 | 5/2000 |
| JP | 2002-149133 | 5/2002 |
| JP | 2002-352593 | 12/2002 |
| JP | 2003-058097 | 2/2003 |
| JP | 2003-058133 | 2/2003 |
| JP | 2003-167543 | 6/2003 |

OTHER PUBLICATIONS

International Search Opinion mailed Dec. 28, 2004.

Razavi, B., "Design of analog CMOS integrated circuits" published, Matuzen Co., Ltd., Mar. 30, 2003.

Japanese Action Office issued on Aug. 14, 2008 for corresponding Japanese Application No. 2003-401274.

* cited by examiner

CLOCKED INVERTER CIRCUIT, LATCH CIRCUIT, SHIFT REGISTER CIRCUIT, DRIVE CIRCUIT FOR DISPLAY APPARATUS, AND DISPLAY APPARATUS

BACKGROUND OF THE INVENTION

1. Technical Field

The present invention relates to clocked inverter circuits, latch circuits, shift register circuits, drive circuits for display apparatuses, and display apparatuses, and is applicable to, for example, flat display apparatuses including organic EL (electroluminescence) devices. The present invention relates to a technology in which switching circuits implemented by a set of transistors that switch operations in a complementary manner form a series circuit, an output of the connection midpoint of the series circuit is output to an inverter circuit, an input signal is input to one end of the series circuit, and a signal that is output from an inverter circuit and that corresponds to the output of the connection midpoint of the series circuit is supplied to an opposite end of the series circuit, thereby allowing an operation using only single-channel transistors.

2. Background Art

Conventionally, in a flat display apparatus, a shift register circuit provided in a vertical drive circuit sequentially transfers drive signals to generate drive signals for pixels, for example, as disclosed in Japanese Unexamined Patent Application Publication No. 5-265411. Such a shift register circuit is formed by serially connecting latch circuits for latching input signals with reference to clocks and outputting the resulting signals, for example, as disclosed in Japanese Unexamined Patent Application Publication No. 5-241201.

FIG. 1 is a wiring diagram showing the latch circuit. In this latch circuit 1, P-channel MOS transistors TR1 and TR2 and N-channel MOS transistors TR3 and TR4 are connected in series between a power supply Vcc and ground. As shown in part (A) in FIG. 2, an input signal IN is input from the previous stage to the transistor TR1 at the power-supply side and the transistor TR4 at the ground side, and a clock CK and a clock CKX, which is an invert signal of the clock CK, are input to the corresponding inner transistors TR2 and TR3 (parts (B) and (C) in FIG. 2). The transistors TR1 to TR4 form a clocked inverter circuit 2 that operates with reference to the clock CK.

Similarly, P-channel MOS transistors TR5 and TR6 and N-channel MOS transistors TR7 and TR8 are connected in series between a power supply Vcc and the ground. In a manner opposite to the transistors TR1 and TR4, the clock CKX and the clock CK are input to the corresponding inner transistors TR6 and TR7. Thus, the transistors TR5 to TR8 form a clocked inverter circuit 3 that operates with reference to the clock CKX having the reverse polarity of the clock CK.

In the latch circuit 1, outputs of the clocked inverter circuits 2 and 3 are input to an inverter circuit 4, in which a P-channel MOS transistor TR9 and an N-channel MOS transistor TR10 are connected in series between a power supply Vcc and the ground. An output of the inverter circuit 4 is fed back to an input of the clocked inverter circuit 3. With this arrangement, a latch circuit for latching the input signal IN based on the clock CK is formed. An output OUT (part (D) in FIG. 2) of the inverter circuit 4 is output to the next stage.

The shift register circuit is formed in such a manner that the latch circuits 1 for latching the input signal IN in response to the rising of such a clock CK and latch circuits in which the connections of the clock CK and the CKX are interchanged relative to the latch circuits 1 are alternately connected in series. A drive signal generated by the timing generator is supplied to the latch circuit at the first stage and is sequentially transferred, so that a drive signal for each pixel is generated.

The latch circuits constituting such a shift register have a drawback in that it is difficult to fabricate the latch circuits using amorphous silicon TFTs (thin film transistors), which can be formed on a glass substrate. That is, the amorphous silicon TFTs (thin film transistors) exhibit a small mobility, about 1/100th of that of transistors containing single-crystal silicon or polysilicon, thus posing a drawback in that P-channel transistors cannot be fabricated.

In a flat display apparatus in which pixels are configured using amorphous silicon, a pixel section in which the pixels are arranged is formed on a glass substrate and drive circuits fabricated in a separate process by using single-crystal silicon or polysilicon are connected to the pixel section on the glass substrate.

That is, as shown in FIG. 3, in a flat display apparatus 11 of such a type, a pixel section 12 in which pixels are arranged in a matrix is formed on a glass substrate 13. In a separate process, integrated circuits including vertical drive circuits 14A and 14B for sequentially driving the pixels of the pixel section 12 line by line are formed, using single-crystal silicon, polysilicon, or the like, by shift registers. The integrated circuits including the vertical drive circuits 14A and 14B are then arranged at the circumference of a glass substrate 13 in conjunction with the integrated circuit of a horizontal drive circuit 15 for setting the gradations of the pixels.

If such drive circuits including the sift register circuits can be fabricated using TFTs containing amorphous silicon, such drive circuits and the pixels can be integrally formed on a glass substrate. Correspondingly, it would be possible to simplify the manufacturing process of such a flat display panel apparatus. To this end, it is necessary to provide clocked inverter circuits and latch circuits that operate only with single-channel transistors that can be created using amorphous-silicon TFTs.

DISCLOSURE OF THE INVENTION

The present invention has been made in view of the foregoing points, and the present invention provides a clocked inverter circuit that operates with only single-channel transistors, a latch circuit, a shift register including latch circuits, a display-apparatus drive circuit, and a display apparatus.

In order to overcome the above-described problems, the present invention is applied to a clocked inverter circuit in which all transistors are same-channel transistors. The clocked inverter circuit includes: a first series circuit in which a set of transistors that switch operations in a complimentary manner based on clocks are connected in series, an input signal being input to one end of the series circuit; a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

In the configuration of the present invention, the clocked inverter circuit includes: a first series circuit in which a set of transistors that switch operations in a complimentary manner based on clocks are connected in series, an input signal being input to one end of the series circuit; a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit. With this arrangement, for example, all transistors are formed by N-channel transistors, and after an output of the first series circuit is set so as to correspond to the input signal in response to the on operation of the switching circuit at one end, the output of the first series circuit can be set so as to maintain the output of the first series circuit in response to the on operation of the switching circuit at another end. Thus, the signal level of an input signal received in response to the on-state of the switching circuit at the one end can be maintained. Thus, all transistors in a clocked inverter circuit can be formed by N-channel transistors.

The present invention also is applied to a latch circuit in which all transistors are same-channel transistors. The latch circuit includes: a first series circuit in which a set of transistors whose operations are switched in a complimentary manner based on clocks are connected in series, an input signal being input to one end of the series circuit; a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

The present invention also is applied to a shift register circuit in which a latch circuit sequentially transfers a drive signal. In the latch circuit, all transistors are formed by same-channel transistors. The latch circuit includes: a first series circuit in which a set of transistors that switch operations in a complementary manner based on clocks are connected in series, an input signal being input to one end of the series circuit; a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

The present invention also is applicable to a drive circuit for a display apparatus in which pixels are arranged in a matrix. In the drive circuit, a shift register circuit including latch circuits sequentially transfers drive signals to generate drive signals for the pixels. In the latch circuit, all transistors are formed by same-channel transistors. The latch circuit includes: a first series circuit in which a set of transistors that switch operations in a complementary manner based on clocks are connected in series; an input signal being input to one end of the series circuit; a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

The present invention also is applied to a display apparatus in which pixels are arranged in a matrix. In the display apparatus, a shift register circuit including latch circuits sequentially transfers drive signals to generate drive signals for the pixels. In the latch circuit, all transistors are formed by same-channel transistors. The latch circuit includes: a first series circuit in which a set of transistors that switch operations in a complementary manner based on clocks are connected in series, an input signal being input to one end of the series circuit; a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

Thus, according to the configuration of the present invention, for example, all transistors can be formed by N-channel transistors to form latch circuits and shift register circuits. According to the configuration of the present invention, it is possible to form display-apparatus drive circuits using those shift registers. In addition, according to the configuration of the present invention, it is possible to provide display apparatuses including the shift register circuits.

According to the present invention, it is possible to provide clocked inverter circuits and latch circuits that operate only with single-channel transistors, shift register circuits including the latch circuits, and display-apparatus drive circuits and display apparatuses including the shift register circuits.

BEST MODE FOR CARRYING OUT THE INVENTION

Embodiments of the present invention will be described below in detail with reference to the drawings.

(1) Configuration of First Embdiment

Figure 1:
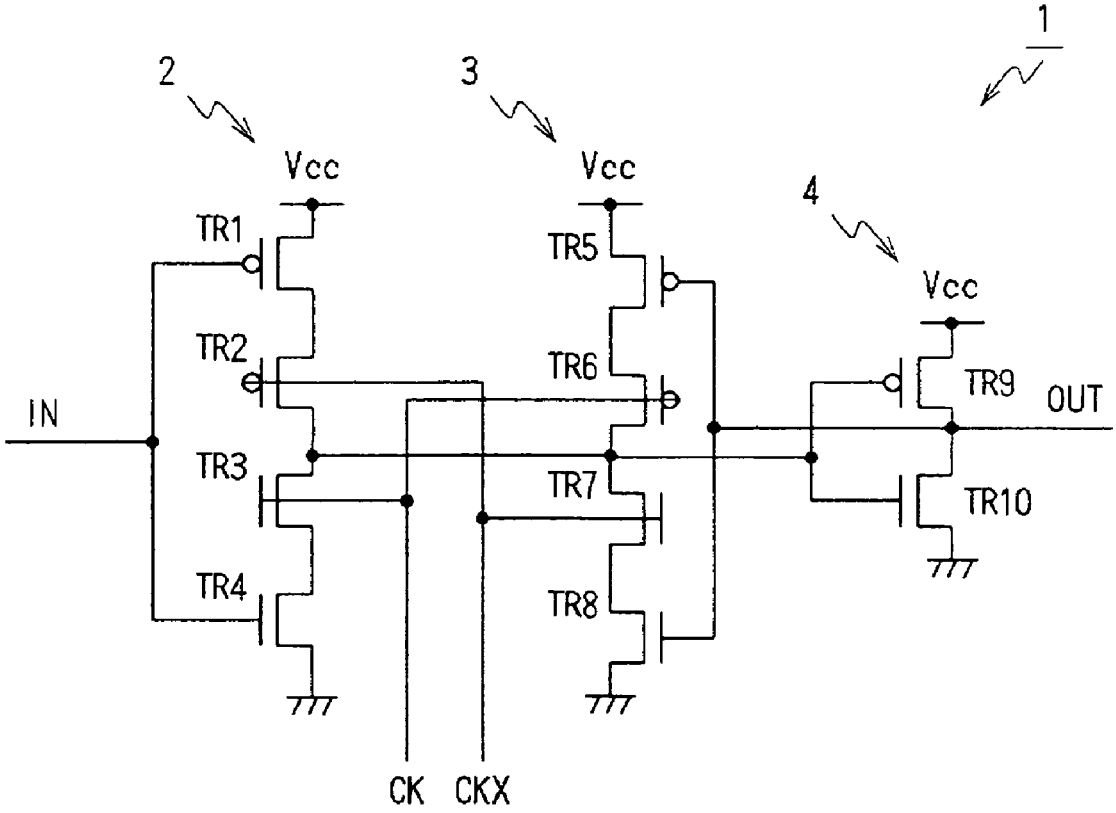
FIG. 1 is a wiring diagram showing a clocked inverter circuit applied to a vertical drive circuit of a known flat display apparatus.
Figure 2:
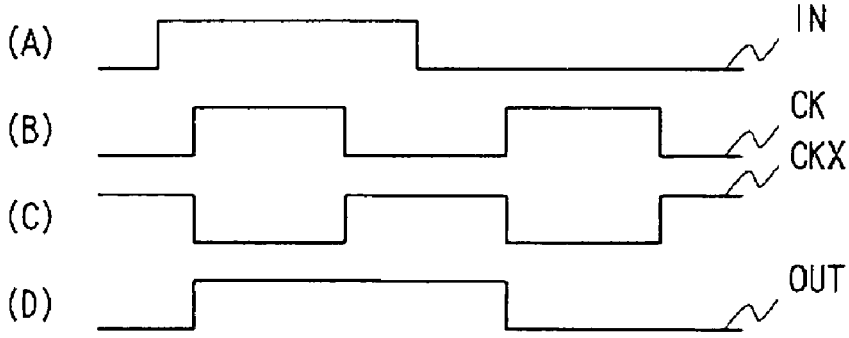
FIG. 2 is a time chart for describing the operation of the clocked inverter circuit shown in FIG. 1.
Figure 3:
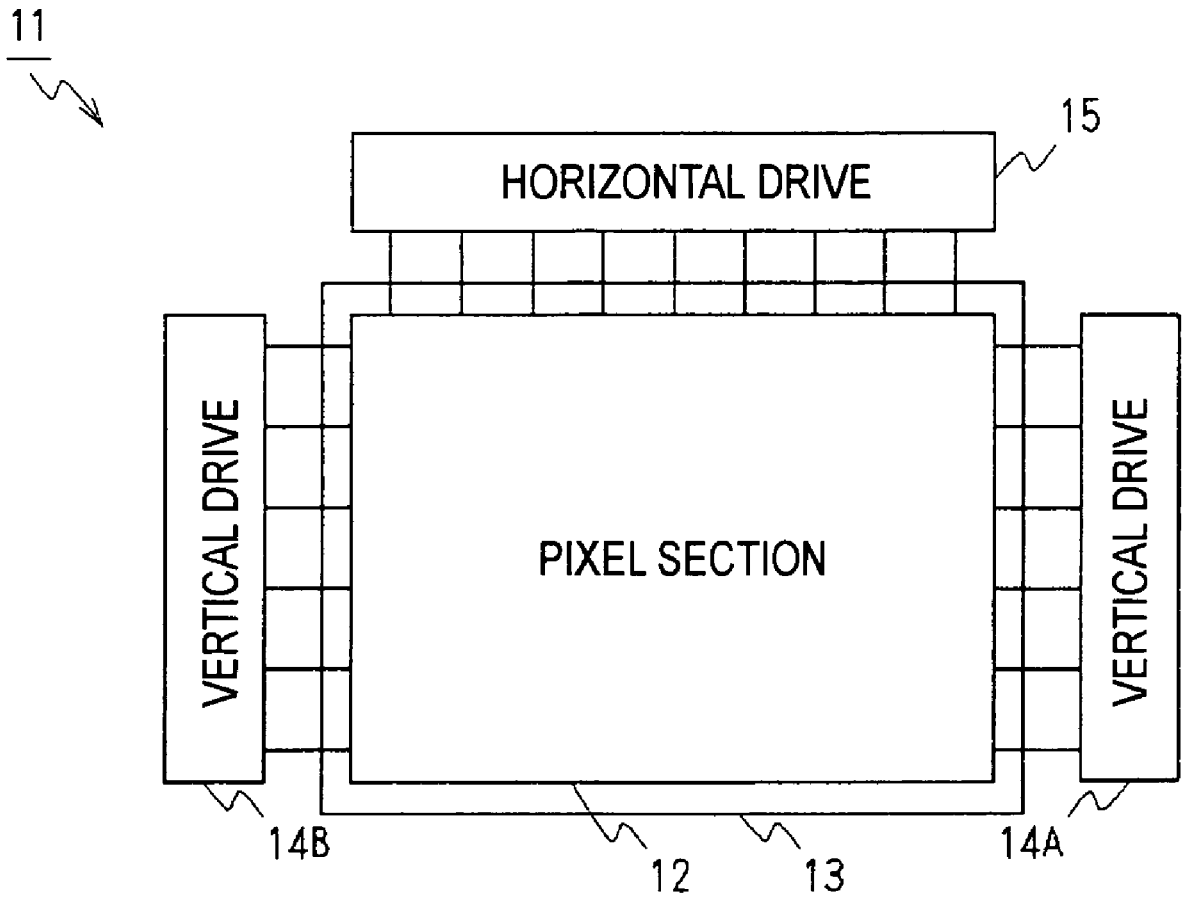
FIG. 3 is a block diagram showing the configuration of a known flat display apparatus.
Figure 4:
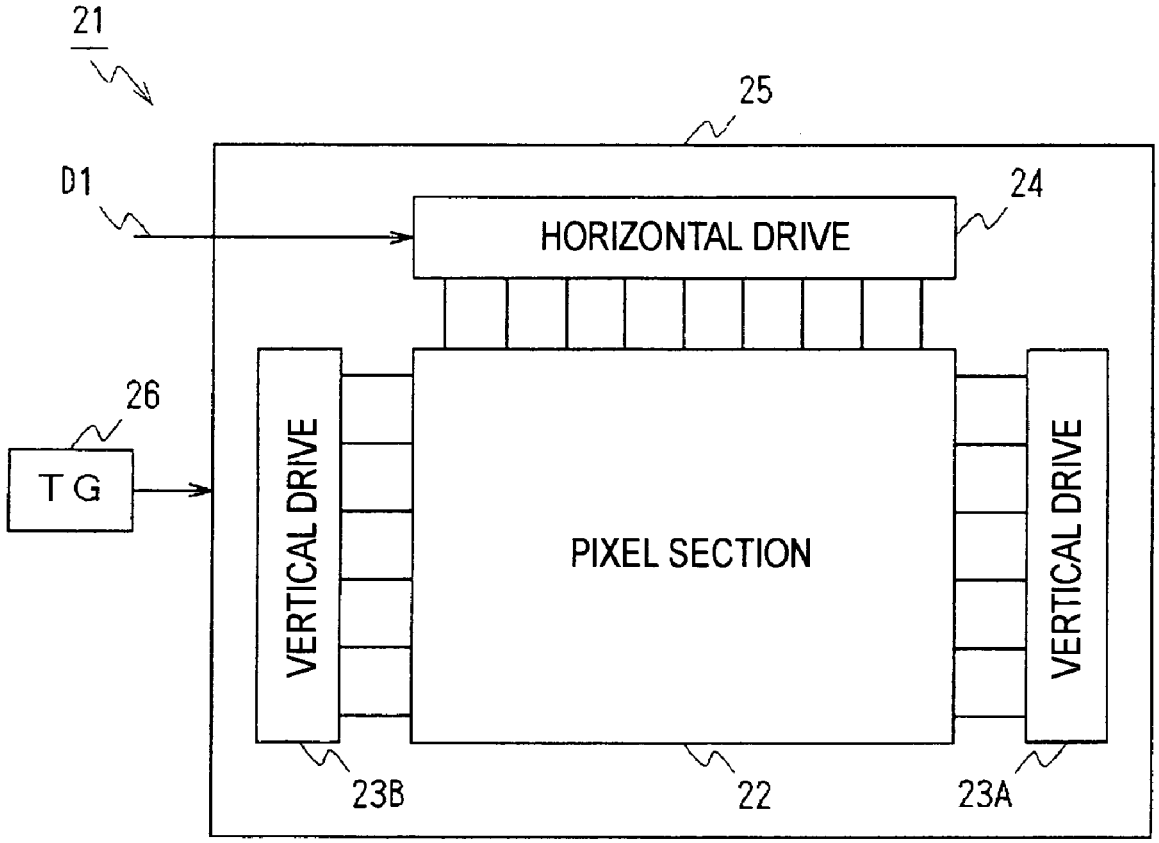
FIG. 4 is a block diagram showing a flat display apparatus according to a first embodiment of the present invention.

FIG. 4 is a block diagram showing a flat display apparatus according to a first embodiment of the present invention. In this flat panel display apparatus 21, a pixel section 22, a vertical drive circuits 23A and 23B, and a horizontal drive circuit 24 are integrally formed on a glass substrate 25 by using amorphous-silicon N-channel-side TFTs. Pixels including organic EL devices are arranged on the pixel section 22 in a matrix. The vertical drive circuits 23A and 23B output drive signals to the pixel section 22 via scan lines, which are provided so as to extend in the horizontal direction of the pixel section 22. The horizontal drive circuit 24 sets the gradations of the respective pixels via signal lines, which are provided so as to extend in the vertical direction of the pixel section 22. In the flat panel display apparatus 21, a timing generator (TG) 26 generates various drive signals, clocks, and so on required for the operations of the vertical drive circuits 23A and 23B and the horizontal drive circuit 24 and supplies the drive signals and so on to the vertical drive circuits 23A and 23B and the horizontal drive circuit 24, which are provided on the glass substrate 25. Further, gradation data D1 indicating the gradation of each pixel is supplied to the horizontal drive circuit 24. Consequently, a desired image is displayed.

Figure 5:
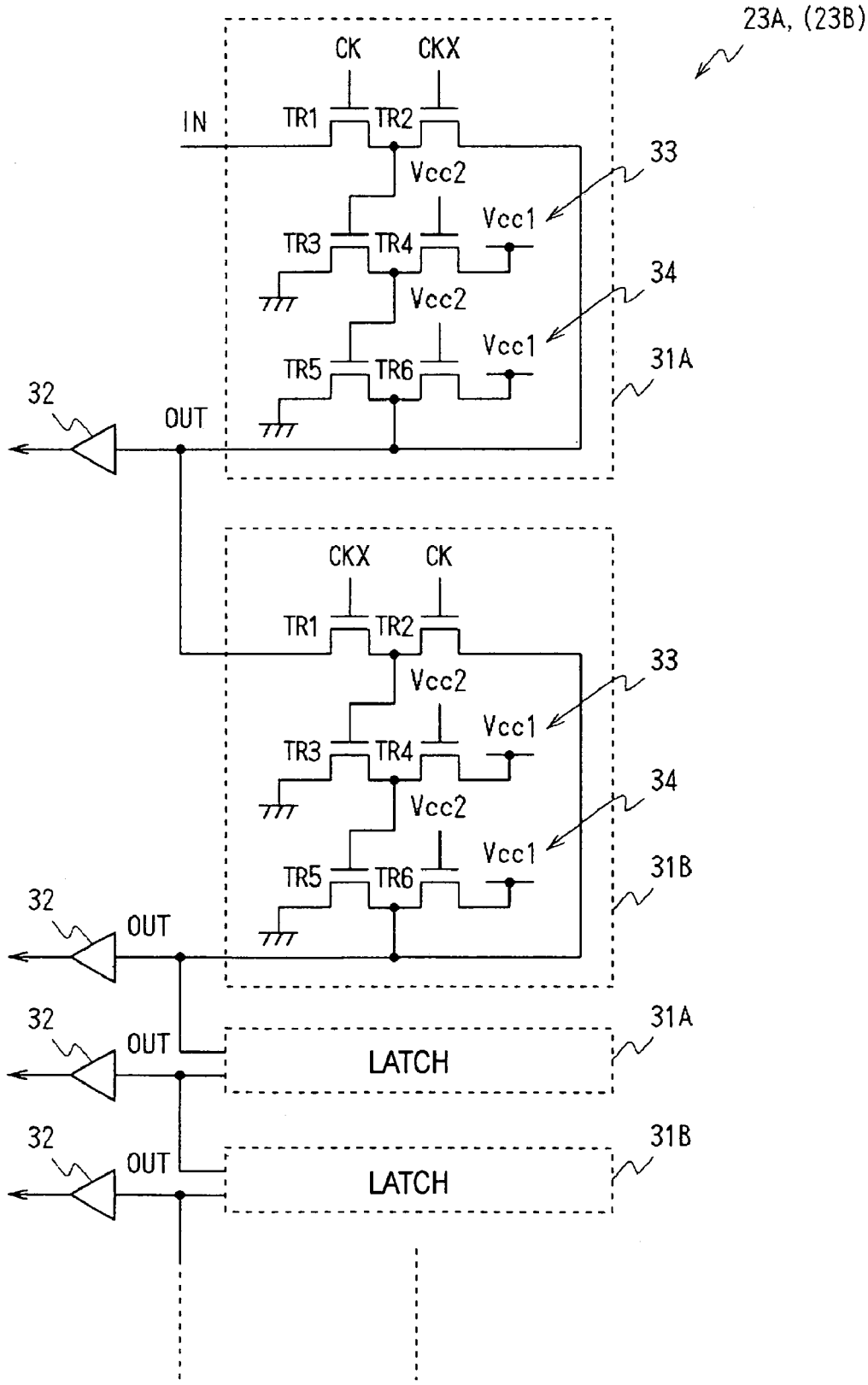
FIG. 5 is a wiring diagram showing a vertical drive circuit in the flat display apparatus shown in FIG. 4.

FIG. 5 is a wiring diagram showing the vertical drive circuit 23A. In the vertical drive circuit 23A, latch circuits 31A, 31B, 31A, . . . sequentially transfer drive signals IN output from the timing generator 26 in the vertical direction of the pixel section 22, and buffer circuits 32 output signals output from the respective circuits 31A, 31B, 31A, . . . to the respective scan lines of the pixel section 22. The vertical drive circuit 23B has the same configuration as the vertical drive circuit 23A, except that drive signals output from the timing generator 26 and transferred as described above are different. Thus, the description of the vertical drive circuit 23B will be omitted hereinafter.

The vertical drive circuit 23A is formed such that the latch circuits 31A for latching input-signals based on a clock CK having a duty ratio of about 50[%] and the latch circuits 31B for latching input signals based on a clock CKX, which is an inverse signal of the clock CK, are alternately connected in series. The drive signal IN generated by the timing generator 26 is input to the latch circuit 31A at the first stage.

In each latch circuit 31A for latching the input signal based on the clock CK, the gates of transistors TR1 and TR2 are driven by the clocks CK and CKX, respectively, and the transistors TR1 and TR2 provide switching circuits that perform on/off operations by switching operations in a complementary manner. The switching circuits are connected in series to thereby form a series circuit of the switching circuits. In the latch circuit 31A at the first stage, the drive signal IN output from the timing generator 26 is input to one end of the series circuit, i.e., to the transistor TR1 that is turned on based on the clock CK. In each latch circuit 31A other than the one located at the first stage, an output signal of the latch circuit 31B at the previous stage is input to one end of the latch circuit 31A. In the latch circuit 31A, an output signal that varies in signal level according to an output of the connection midpoint of the series circuit is input to an opposite end of the series circuit. In this embodiment, as the output signal, an output signal of a second inverter circuit 34, described below, is used.

That is, in the latch circuit 31A, transistors TR3 and TR4 are connected in series between a power supply Vcc1 and ground to form a first inverter circuit 33 and, similarly, transistors TR5 and TR6 are connected in series to form the second inverter circuit 34. In the first and second inverter circuits 33 and 34, the gates of the transistors TR4 and TR6 at the power supply voltage Vcc1 side are connected to reference voltages Vcc2, respectively. In the inverter circuit 33 located at the previous-stage side, the gate of the ground-side transistor TR3 is connected to the connection midpoint of the transistors TR1 and TR2. In the inverter 34 at the subsequent-stage side, similarly, an output of the inverter circuit 33 including the previous-stage transistors TR3 and TR4 is input to the gate. of the ground-side transistor TR5. An output of the second inverter circuit 34 is used as an output OUT of the latch circuit 31A.

Figure 6:
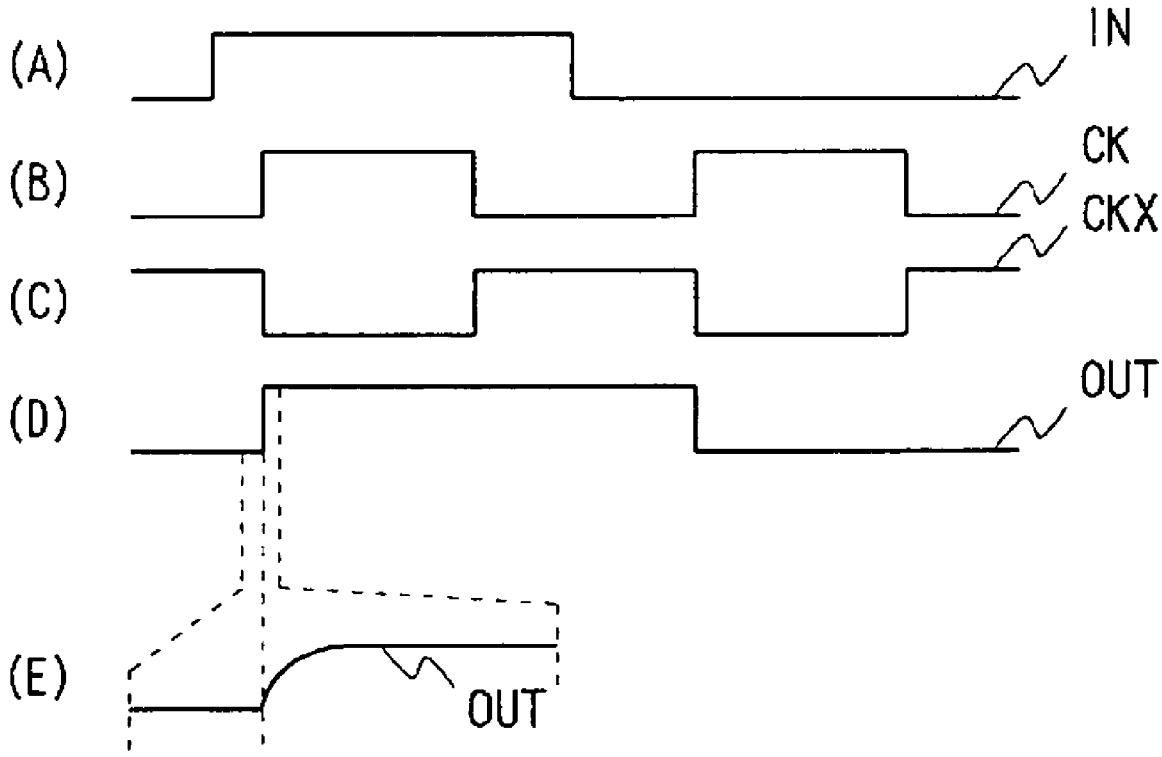
FIG. 6 is a time chart for describing the operation of the latch circuit in the vertical drive circuit shown in FIG. 5.
Figure 7:
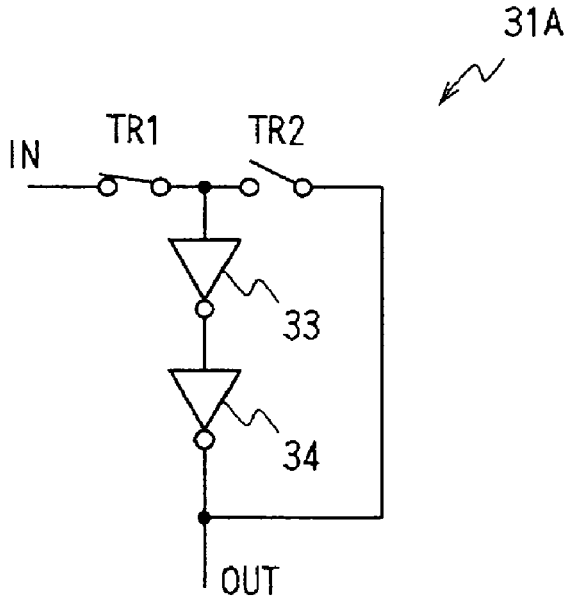
FIG. 7 is a wiring diagram for describing the operation of the latch circuit in the vertical drive circuit shown in FIG. 5.

Thus, in the latch circuit 31A, as shown in FIGS. 6 and 7, the input signal IN (part (A) of FIG. 6), whose signal level rises at predetermined timing, is input. In accordance with the rising and falling (parts (B) and (C) of FIG. 6) of the clock signals CK and CKX, the input signal IN is supplied to a series circuit constituted by the inverter circuit 33, which includes the transistors TR3 and TR4, and the inverter 34, which includes the transistors TR5 and TR6, via the switching circuit implemented by the transistor TR1. In response to the rising of the input signal IN, the output signal OUT (part (C) of FIG. 6) rises.

Figure 8:
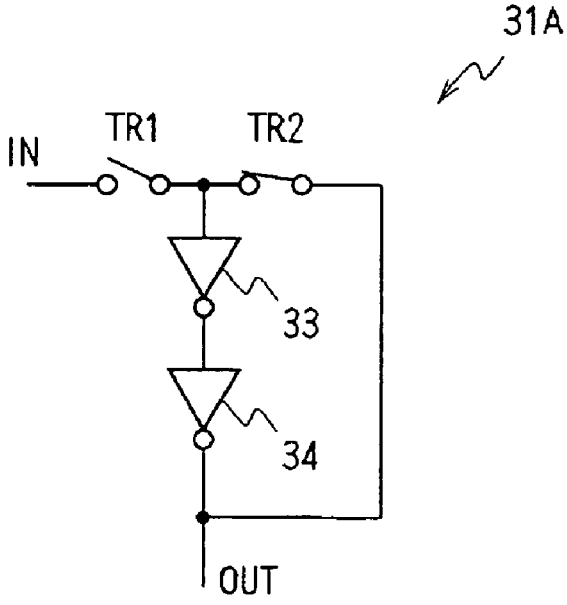
FIG. 8 is a wiring diagram for describing an operation subsequent to the operation in FIG. 7.

After the output signal OUT rises as described above, when the clock CK begins to fall and the clock CKX begins to rise, the switching circuits implemented by the transistors TR1 and TR2 are switched to an OFF state and an ON state, respectively, as shown in FIG. 8. In this case, a signal output from the second inverter 34 is input to the switched-on switching circuit thereby maintaining the circuit output at a High level, even after the transistor TR1 is switched off due to the gate capacitance. Consequently, the output signal of the second inverter circuit 34, the output signal is maintained at the High level, because the output signal is instantaneously input to the series circuit, constituted by the inverter circuits 33 and 34, via the switching circuit implemented by the transistor TR2. Thus, the signal level of the input signal IN received based on the clock CK is maintained.

Thus, in the latch circuit 31A, after the input signal IN falls, similarly, in response to the rising and falling of the clock CK and clock CKX, the signal level of the input signal IN is received and maintained.

In contrast, in the latch circuit 31B that operates with reference to the clock CKX, clocks for driving the switching circuits implemented by transistors TR1 and TR2 are set to the clock CKX and the clock CK, respectively, in a manner opposite to the case of the latch circuit 31A. Thus, the result of latching of the previous-stage latch circuit 31A is output with a delay of one-half cycle of the clock CK.

As described above, a shift register circuit is configured in the vertical drive circuit 23A, and the drive signal IN output from the timing generator 26 is sequentially output with a delay of one-half cycle of the clock CK.

In the latch circuit 31A, in order to ensure that output signals at the outputs of the inverter circuits 33 and 34 fall to have appropriate signal levels when the series circuit of the inverter circuits 33 and 34 outputs the input signal IN with the delay, the transistors TR3 and TR5 at the ground side are fabricated to have a larger size than the transistors TR4 and TR6 at the power supply Vcc side to reduce the on-resistance.

The reference voltage Vcc2 of the inverter circuits 33 and 34 is set at a higher voltage than the voltage of the power supply Vcc so as to correspond to the threshold voltage of the transistors TR4 and TR6 at the power supply Vcc side, so that the inverter circuits 33 and 34 do not cut off the outputs.

As described above, in this embodiment, the transistors TR1 and TR2 constitute a first series circuit constituted by a set of transistors that are switched to the ON state in a complementary manner, and the transistors TR3 and TR4 constitute a first inverter circuit constituted by a set of transistors, the connection midpoint of the first series circuit being connected to the gate of one of the transistors to the first inverter circuit. The transistors TR5 and TR6 constitute a second inverter circuit constituted by a pair of transistors that output an in-phase signal of the input signal, the in-phase signal having a signal level that varies with a delay relative to the input signal IN. In this embodiment, the input signal IN is input to one end of the first series circuit and the in-phase signal is input to the opposite end of the first series circuit.

(2) Operation of First Embodiment

In the configuration described above, in the flat panel display apparatus 21 (FIG. 4), the pixels provided at the pixel section 22 are driven line by line by the drive signals output from the vertical drive circuits 23A and 23B and the gradations of the respective signals are sequentially set by the drive signals output from the horizontal drive circuit 24 to the respective signal lines, so that a desired image is displayed. In the flat panel display apparatus 21 (FIG. 5), the drive signal IN output from the timing generator 26 is sequentially transferred by the shift register in the vertical direction of the pixel section 22 and the output signals of the individual stages of the shift register are output to the corresponding scan lines of the pixel section 22, thereby executing the pixel driving by the vertical drive circuits 23A and 23B. In the flat display apparatus 21, the shift register is formed by a series circuit constituted by the latch circuits 31A, 31B, 31A, 31B, . . . .

In the latch circuit 31A, the drive signal IN output from the timing generator 26 or the drive signal output from the previous-stage latch circuit 31B is supplied to the first series circuit constituted by the switching circuits, which are implemented by the transistors TR1 and TR2 that perform on/off operations in a complementary manner, and an output of the connection midpoint of the first series circuit is output to the next stage via the first and second inverters 33 and 34. In the latch circuit 31A, the input signal IN is input via the transistor TR1 of the first series circuit. In turn, when the clock signal CK for controlling the on and off of the transistor TR1 rises, the output OUT of the latch circuit 31A is set to have the signal level of the input signal IN with a delay corresponding to the operation time of the inverters 33 and 34. Thus, the signal level of the input signal IN is obtained with reference to the clock signal CK.

When the clock CK falls, the transistor TR2 is switched on by the clock signal CKX, which is the inverse signal of the clock CK, and the output signal OUT, which is delayed by an amount of time corresponding to the operation time of the inverter circuits 33 and 34, is input to the first series circuit via the transistor TR2, thus maintaining the signal level of the output signal OUT set at the rising of the clock signal CK.

Thus, in the latch circuit 31A, N-channel transistors TR1 to TR6 can be used to latch the input signal IN and to output the resulting signal.

In the shift register circuit, the latch circuits 31A for latching the input signal based on a clock signal CK as described above and the latch circuits 31B for latching the input signal based on a clock CKX, which is the inverse signal of the clock CK, are alternately connected in series. In the latch circuit 31B, the clock CK and the clock CKX are interchanged relatively to the latch circuit 31A. With this arrangement, the drive signal output from the timing generator 26 at one-half cycle of the clock CK is sequentially transferred. Thus, in this shift register circuit, all transistors can be formed by N-channel transistors to generate a drive signal.

Consequently, the flat display apparatus 21 and the vertical drive circuits, which are drive circuits for the flat display apparatus 21, can be formed using amorphous silicon TFTs, and the flat display apparatus can be fabricated by a simple process in which the drive circuits and a pixel section are integrally formed on a glass substrate.

(3) Advantages of First Embodiment

According to the configuration described above, switching circuits implemented by a set of transistors that switch operations in a complementary manner form a series circuit, an output of the connection midpoint of the series circuit is output to an inverter circuit, an input signal is input to one end of the series circuit, and a signal that is output from an inverter circuit and that corresponds to the output of the connection midpoint of the series circuit is supplied to an opposite end of the series circuit. With this arrangement, it is possible to provide a latch circuit that operates with only single-channel transistors, a shift register including the latch circuit, a display-apparatus drive circuit, and a display apparatus.

Relative to a first inverter circuit to which the output of the connection midpoint of the series circuit is input, a second inverter circuit in which an output signal of the first inverter circuit is input to the gate of one of the transistors of the second inverter circuit is provided. An output signal of the second inverter circuit is input to the opposite end of the series circuit. With this arrangement, a signal with a delay relative to the input signal can be generated with a simple configuration.

(4) Second Embodiment

Figure 9:
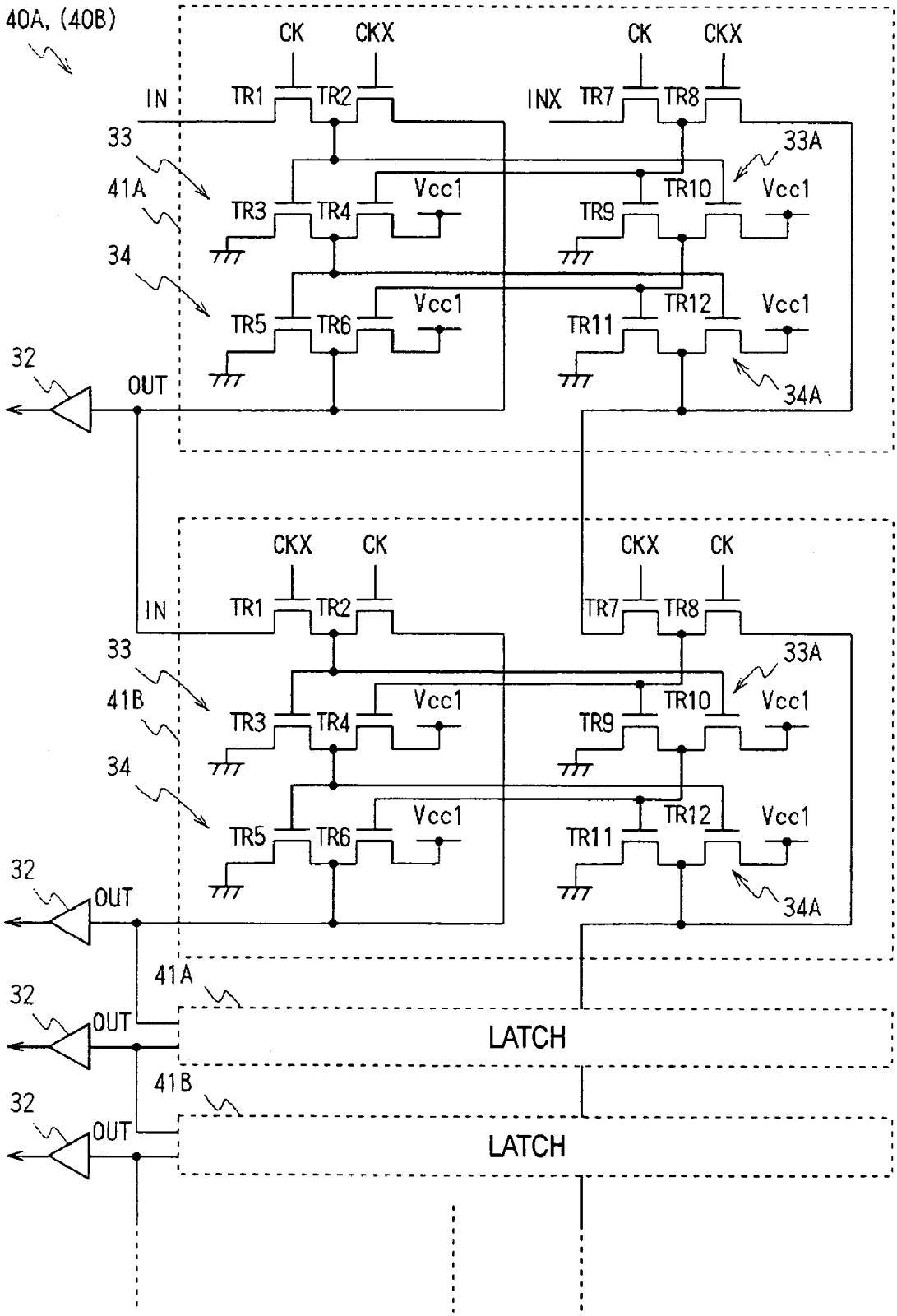
FIG. 9 is a wiring diagram showing a vertical drive circuit in a flat display apparatus according to a second embodiment of the present invention.

FIG. 9 is a wiring diagram showing a vertical drive circuit in a flat display apparatus according to a second embodiment of the present invention. In this vertical drive circuit 40A or 40B, latch circuits 41A and 41B are used instead of the latch circuits 31A and 31B described above in the first embodiment. The flat display apparatus according to the second embodiment has the same configuration as the flat display apparatus 21 described in the first embodiment, except that the configurations of the latch circuit 41A and 41B are different. Thus, redundant descriptions will be omitted hereinafter.

In the latch circuits 31A and 31B described above in the first embodiment, the size of the ground-side transistors TR3 and TR5 of the inverter circuits 33 and 34 must be fabricated to have a large size so as to sufficiently reduce the on-resistance, in order to ensure that the output signal OUT has a sufficiently dynamic range. Furthermore, when the ground-side transistors TR3 and TR5 are turned on, current flows from the power supply Vcc to the ground, thereby increasing the power consumption. As shown in part (E) of FIG. 6, there is also a drawback in that the rising edge and the falling edge of the output signal OUT are rounded. In this embodiment, the drawbacks of the first embodiment are eliminated.

That is, similarly to the latch circuit 31A according to the first embodiment, the latch circuit 41A in the second embodiment includes a first series circuit constituted by transistors TR1 and TR2, an inverter circuit 33 constituted by transistors TR3 and TR4, and a second inverter circuit 34 constituted by transistors TR5 and TR6. An input signal IN or an output signal of the previous stage is input to one end of the first series circuit and an output signal of the second inverter circuit 34 is input to an opposite end of the first series circuit. An output of the connection midpoint of the series circuit is input to the inverter circuit 33 and an output signal of the inverter circuit 33 is input to the second inverter circuit 34.

The latch circuit 41A has a second system relative to a first system including the first series circuit, the first inverter circuit 33, and the second inverter circuit 34. The second system includes a first series circuit, a first inverter circuit 33A, and a second inverter circuit 34A which correspond to the first series circuit, the first inverter circuit 33, and the second inverter circuit 34.

Similarly to the first system, in the second system, switching circuits implemented by transistors TR7 and TR8 for switching operations by performing on/off operations in a complimentary manner based on the clocks CK and CKX form the first series circuit. In the first inverter circuit 33A, transistors TR9 and TR10 are connected in series and an output of the connection midpoint of a series circuit constituted by transistors TR7 and TR8 is input to the gate of the ground-side transistor TR9. In the second inverter circuit 34A, the transistors TR9 and TR10 are connected in series and an output signal of the first inverter circuit 33A is input to the gate of a ground-side transistor TR11. Further, an output signal of the second inverter circuit 34A is fed back to an opposite end of the series circuit of the transistors TR7 and TR8.

The second system is formed so as to correspond to the first system, as described above. An input signal INX, whose polarity is inverted relative to the input signal IN input to the first system, is input to one end at the clock CK side of the series circuit constituted by the transistors TR7 and TR8, so that sections corresponding to those in the first system generate signals having reverse polarities relative to the first system.

In the latch circuit 41A, the signals having reverse polarities control the on and off of the power-supply-side transistors TR4 and TR6 of the first and second inverter circuits 33 and 34 in the first system, so that the power-supply-side transistors TR4 and TR6 and the ground-side transistors TR3 and TR5 in the inverter circuits 33 and 34 perform on/off operations in a complementary manner. This prevents the rounding of the rising edge and falling edge of the output signals of the inverter circuits 33 and 34 and reduces the power consumption. Furthermore, even when the transistors TR3 to TR6 in the inverter circuits 33 and 34 are formed to have small sizes, the output signal OUT having a sufficient dynamic range can be output.

In the latch circuit 41A, with regard to the first and second inverters 33A and 34A in the second system, similarly, signals having reverse polarities relative to the first system control the on and off of the power-supply-side transistors TR10 and TR12. Thus, the power-supply-side transistors TR10 and TR12 and the ground-side transistors TR9 and TR11 in the inverter circuits 33A and 34A also are turned on and off in a complementary manner. This prevents the rounding of the rising edge and falling edge of the output signals of the inverter circuits 33A and 34A and reduces the power consumption. Furthermore, even when the transistors TR9 to TR12 in the inverter circuits 33A and 34A are formed to have small sizes, an output signal having a sufficient dynamic range can be output.

That is, in the latch circuit 41A, in the inverter circuit 33 of the first system, an output of the connection midpoint of the transistors TR7 and TR8 in the second system is input to the gate of the power-supply-side transistor TR4 and in the second inverter circuit 34 of the first system, an output signal of the first inverter circuit 34A in the second system is input to the gate of the power-supply-side transistor TR6. Similarly, in the first inverter circuit 33A of the second system, an output of the connection midpoint of the transistors TR1 and TR2 in the first system is input to the gate of the power-supply-side transistor TR10, and in the second inverter circuit 34A of the second system, an output signal of the first inverter circuit 34 in the first system is input to the gate of the power-supply-side transistor TR12.

With this arrangement, the transistors TR1 to TR12 in the latch circuit 41A can be formed to have substantially the same small size. The inverse signal INX of the input signal IN is generated by the timing generator 26.

The latch circuit 41A outputs the output signals of the first and second systems to the latch circuit 41B at the next stage. This next-stage latch circuit 41B is formed such that the clock CK and the clock CKX are switched relative to the latch circuit 41A that latches the input signal based on the clock CK.

Thus, in this embodiment, the latch circuits 41A, 41B, 41A, . . . sequentially transfer the drive signal IN with a delay of one-half cycle of the clock CK and the resulting drive signal is output to each scan line via the buffer circuit 32.

In the configuration shown in FIG. 9, the second system corresponding to the first system is formed and the first system and the second system generate signals having reverse polarities, and the signals having reverse polarities are used to control the on and off of the power-supply-side transistors of the inverter circuits in the first and second systems. This allows for a reduction in power consumption, an improvement in the transition of the output signals, and the formation using small transistors, thus providing advantages similar to the first embodiment.

(5) Third Embodiment

Figure 10:
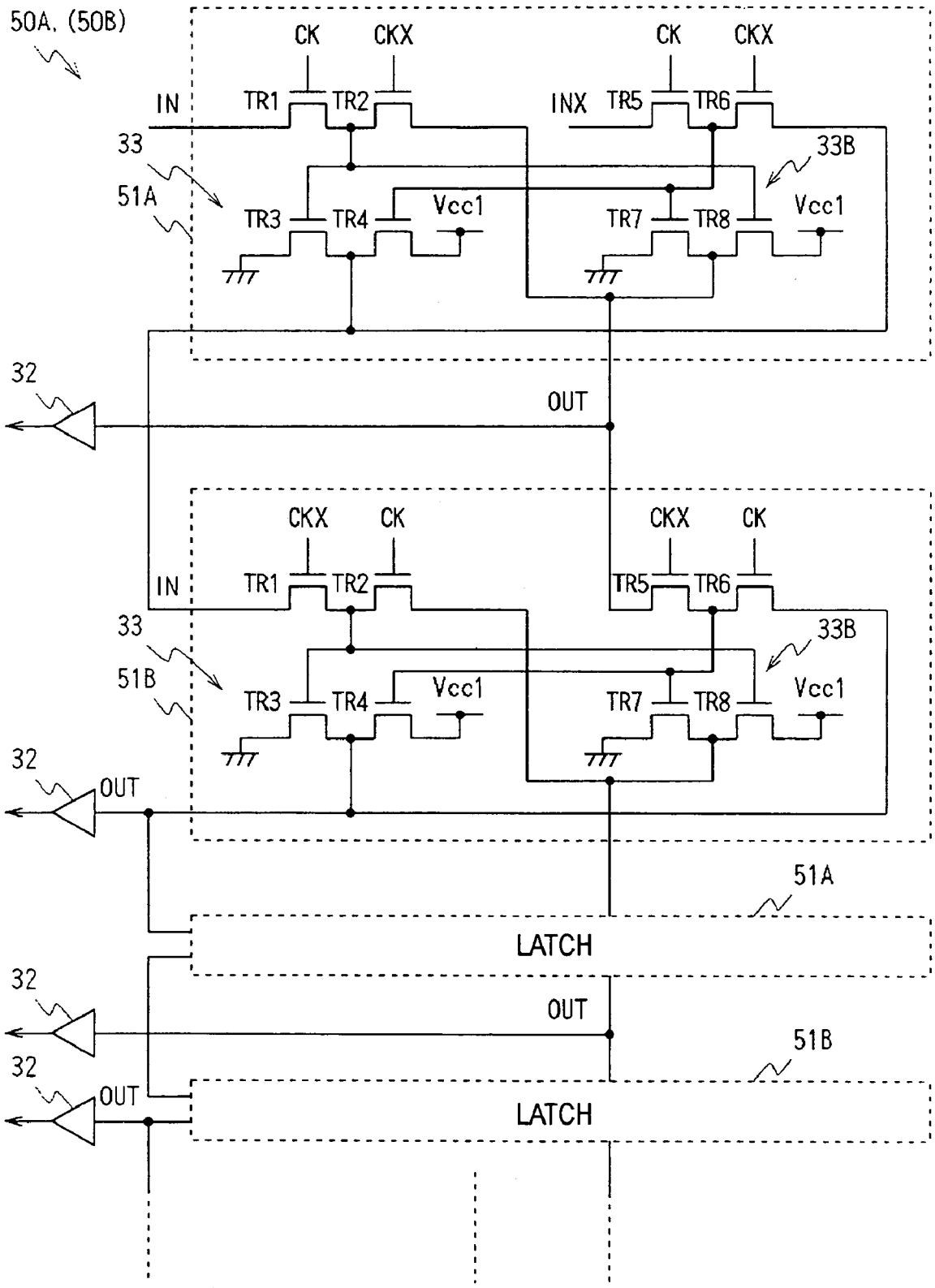
FIG. 10 is a wiring diagram showing a vertical drive circuit in a flat display apparatus according to a third embodiment of the present invention.

FIG. 10 is a wiring diagram showing a vertical drive circuit in a flat display apparatus according to a third embodiment of the present invention. In this vertical drive circuit 50A or 50B, latch circuits 51A and 51B are used instead of the latch circuits 31A and 31B described above in the first embodiment. The flat display apparatus in the third embodiment has the same configuration as the flat display apparatus 21 described above in the first embodiment, except that the configurations of the latch circuit 51A and 51B are different. Thus, redundant descriptions will be omitted hereinafter.

Similarly to the latch circuit 31A according to the first embodiment, the latch circuit 51A includes a first series circuit constituted by transistors TR1 and TR2 and an inverter circuit 33 constituted by transistors TR3 and TR4. An input signal IN or an output signal of the previous stage is input to one end of the first series circuit, and an output of the connection midpoint of the first series circuit is input to the inverter circuit 33.

In the latch circuit 51A, similarly to the first series circuit, a second series circuit is constituted by switching circuits implemented by transistors TR5 and TR6 that switch operations in a complementary manner by performing on/off operations based on the clocks CK and CKX. An inverse signal INX of an input signal IN or the inverse signal of an output signal OUT of the previous stage is input to the end at the clock CK side of the second series circuit. Transistors TR7 and TR8 form an inverter circuit 33B, and an output of the connection midpoint of the second series circuit is input to the ground-side transistor TR7 of the inverter circuit 33B.

Thus, in the latch circuit 51A, the second series circuit constituted by the transistors TR5 and TR6 and the inverter 33B generate corresponding signals having reverse polarities relative to a system that includes the first series circuit constituted by the transistors TR1 and TR2 and the inverter circuit 33. An output signal corresponding to the output of the connection midpoint of the first series circuit is generated by the inverter circuit 33B for the second series circuit, and an output signal corresponding to the output of the connection midpoint of the second series circuit is generated by the inverter circuit 33 for the first series circuit.

With this arrangement, in the latch circuit 51A, the output signal of the inverter circuit 33B is input to an opposite end of the first series circuit and the output signal of the inverter circuit 33 is input to an opposite end of the second series circuit. The output of the connection midpoint of the second series circuit is input to the power-supply-side transistor TR4 of the inverter circuit 33, and the output of the connection midpoint of the first series circuit is input to the power-supply-side transistor TR8 of the inverter circuit 33B. The output signals of the inverter circuits 33 and 33B also are output to the next stage.

In the latch circuit 51B based on the clock CKX, the clock CK and the clock CKX are interchanged, and the latch circuit 51B has the same configuration as the latch circuit 51A based on the clock CK. In the vertical drive circuits 50A and 50B, according to the configurations of the latch circuits 51A and 51B, inputs to respective buffer circuits 32 are interchanged between the latch circuit 51A based on the clock CK and the latch circuit 51B based on the clock CKX.

In this embodiment, the configuration of the latch circuits are simplified and advantages similar to those in the second embodiment can be provided.

(6) Other Embodiments

A case in which the shift register, which is a vertical drive circuit, has been described in the above embodiments with the objective of outputting a signal having the same phase as an input signal, but the present invention is not limited thereto. For example, the buffer circuits may be configured by inverter circuits so as to output a signal having a phase opposite to an input signal. In this case, in the configuration of the first embodiment, the output signal of the first inverter circuit 33 can be output to the buffer circuit, and in the configuration of the second embodiment, the output signal of the second system side can be output to the buffer circuit. In addition, in the configuration of the third embodiment, the output signals of the inverter circuits 33 and 33B sides in the latch circuits 51A and 51B can be output to the buffer circuits. Thus, in this case, in the configuration of each embodiment, the clocked inverter circuits that receive an input signal IN based on the clock CK and output an inverse signal are connected in series to constitute the shift register circuit.

Although a case in which the scan lines are driven by signals having the same polarity as the drive signal output from the timing generator has been described in the above embodiments, the present invention is not limited thereto, and it is thus widely applicable to a case in which the scan lines are drive by signals having the reverse polarity.

Although a case in which the output of the previous stage is input to the ground-side transistors in the inverter circuit has been described in the above embodiments, the present invention is not limited thereto. Conversely, the output may be input to the power-supply-side transistor.

Although a case in which the latch circuits and the clocked inverter circuits are constituted by N-channel transistors has been described in the above embodiments, the present invention is not limited thereto. The present invention is widely applicable to cases in which the latch circuits and the clocked inverter circuits are constituted by transistors having the same polarity, such as a case in which they are fabricated using P-channel transistors. In such cases, it may be difficult to accomplish the fabrication because of an amorphous process. However, since the fabrication is possible using transistors having the same polarity, the process can be simplified correspondingly.

Although a case in which the drive circuits and the pixel section are integrally fabricated on a glass substrate has been described in the above embodiments, the present invention is not limited thereto. For example, the present invention is widely applicable to a case in which the fabrication is performed in separate processes and also to a case in which the fabrication is performed using single crystal silicon polysilicon. In such cases, since the fabrication is possible using transistors having the same polarity, the processes can be simplified correspondingly.

Although a case in which the latch circuits and the clocked inverter circuits according to the present invention are applied to drive circuits for a flat display apparatus has been described in the above embodiments, the present invention is not limited thereto, and it is thus widely applicable to various drive circuits and logic circuits.

Although a case in which the present invention is applied to a flat display apparatus including organic EL devices has been described in the above embodiments, the present invention is not limited thereto, and it is thus widely applicable to various display apparatus, such as liquid crystal display apparatuses.

INDUSTRIAL APPLICABILITY

The present invention is applicable to, for example, a flat display apparatus including organic EL devices.

The invention claimed is:

1. A clocked inverter circuit in which all transistors are same-channel transistors, the clocked inverter circuit comprising:

a first series circuit in which a set of transistors that switch operations in a complimentary manner based on clocks are connected in series, an input signal being input to one end of the series circuit;

a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

2. A latch circuit in which all transistors are same-channel transistors, the latch circuit comprising:

a first series circuit in which a set of transistors whose operations are switched in a complimentary manner based on clocks are connected in series, an input signal being input to one end of the series circuit;

a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

3. The latch circuit according to claim 2, wherein the second inverter circuit is an inverter circuit that inputs an output signal of the first inverter circuit to one of the transistors.

4. The latch circuit according to claim 3, further having a second system relative to a first system including the first series circuit, the first inverter circuit, and the second inverter circuit, the second system including a first series circuit, a first inverter circuit, and a second inverter circuit which correspond to the first series circuit, the first inverter circuit, and the second inverter circuit included in the first system;

wherein an inverse signal of the input signal is input to one end of the first series circuit in the second system and an output of the second inverter circuit in the second system is input to an opposite end of the first series circuit in the second system, the connection midpoint of the first series circuit in the first system is connected to a gate of another one of the transistors in the first inverter circuit in the second system, and an output of the first inverter circuit in the first system is input to a gate of another one of the transistors in the second inverter circuit in the second system; and wherein a connection midpoint of the first series circuit in the second system is connected to a gate of another one of the transistors in the first inverter circuit in the first system, and an output of the first inverter circuit in the second system is input to a gate of another one of the transistors in the second inverter circuit in the first system.

5. The latch circuit according to claim 2, further having a second series circuit including a set of transistors that switch operations in a complimentary manner in conjunction with the set of transistors of the first series circuit, wherein, in the second series circuit, a reverse signal of the input signal is input to an end corresponding to the end of the first series circuit and an output of the first inverter circuit is input to an end corresponding to the opposite end of the first series circuit;

wherein a gate of another one of the transistors in the first inverter circuit is connected to a connection midpoint of the set of transistors in the second series circuit; and wherein the connection midpoint of the second series circuit is connected to a gate of one of the transistors in the second inverter circuit and a gate of another one of the transistors in the second inverter circuit is connected to the connection midpoint of the set of transistors in the first series circuit.

6. A shift register circuit in which a latch circuit sequentially transfers a drive signal, wherein, in the latch circuit, all transistors are formed by same-channel transistors, and the latch circuit comprises:

a first series circuit in which a set of transistors that switch operations in a complementary manner based on clocks are connected in series, an input signal being input to one end of the series circuit;

a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

7. A drive circuit for a display apparatus in which pixels are arranged in a matrix, wherein a shift register circuit including latch circuits sequentially transfers drive signals to generate drive signals for the pixels, and wherein, in the latch circuit, all transistors are formed by same-channel transistors, and the latch circuit comprises:

a first series circuit in which a set of transistors that switch operations in a complementary manner based on clocks are connected in series, an input signal being input to one end of the series circuit;

a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

8. A display apparatus in which pixels are arranged in a matrix, wherein a shift register circuit including latch circuits sequentially transfers drive signals to generate drive signals for the pixels, and wherein, in the latch circuit, all transistors are formed by same-channel transistors, and the latch circuit comprises:

a first series circuit in which a set of transistors that switch operations in a complementary manner based on clocks are connected in series, an input signal being input to one end of the series circuit;

a first inverter circuit including a set of transistors, a connection midpoint of the first series circuit being connected to a gate of one of the transistors; and a second inverter circuit including a set of transistors that input an output signal, whose signal level varies in response to an output of the connection midpoint of the first series circuit, to an opposite end of the first series circuit.

* * * * *